US006539300B2

(12) United States Patent
Myr

(10) Patent No.: US 6,539,300 B2
(45) Date of Patent: Mar. 25, 2003

(54) METHOD FOR REGIONAL SYSTEM WIDE OPTIMAL SIGNAL TIMING FOR TRAFFIC CONTROL BASED ON WIRELESS PHONE NETWORKS

(75) Inventor: David Myr, Jerusalem (IL)

(73) Assignee: Makor Issues and Rights Ltd., Jerusalem (IL)

( * ) Notice: Subject to any disclaimer, the term of this patent is extended or adjusted under 35 U.S.C. 154(b) by 0 days.

(21) Appl. No.: 09/901,823

(22) Filed: Jul. 10, 2001

(65) Prior Publication Data

US 2003/0014180 A1 Jan. 16, 2003

(51) Int. Cl.[7] ..... G08G 1/07; G08G 1/0965

(52) U.S. Cl. ..... 701/117; 701/118; 455/456; 379/112.01

(58) Field of Search ..... 701/117, 118, 701/119; 340/907, 991–994; 455/456, 457, 458, 507, 521; 379/111, 112.01

(56) References Cited

U.S. PATENT DOCUMENTS 5,465,289 A * 11/1995 Kennedy, Jr. ..... 340/910
5,539,398 A * 7/1996 Hall et al. ..... 340/906
5,668,717 A 9/1997 Spall ..... 701/117
5,745,865 A * 4/1998 Rostoker et al. ..... 455/456
5,798,949 A * 8/1998 Kaub ..... 703/6
5,917,432 A * 6/1999 Rathbone ..... 340/907
6,012,012 A 1/2000 Fleck et al. ..... 701/117
6,133,854 A * 10/2000 Yee et al. ..... 340/907
6,169,495 B1 * 1/2001 Koike ..... 340/435
6,338,021 B1 * 1/2002 Yagyu et al. ..... 340/990
6,341,255 B1 * 1/2002 Lapidot ..... 340/905

* cited by examiner

*Primary Examiner*—Tan Q. Nguyen
(74) *Attorney, Agent, or Firm*—RatnerPrestia

(57) ABSTRACT

A method for the system wide control of signals in a traffic network in real time to provide an overall reduction in congestion is described. In the method, signals obtained from vehicular-based cellular phones provide location information on moving vehicles and are input into an Intelligent Traffic Control System to provide position information that is stored in the form of records. Mathematical models use those records together with detailed digital maps and algorithms to compute actual travel times consumed by traveling along road sections, by queuing near signalized intersections, and by making various allowed turns and go-throughs in the vicinity of signalized intersection areas. The actual travel times measured for a fixed control time period are compared to the corresponding theoretical travel times and form a basis for a mathematical optimization model. Maximization of that model allows computation of adjusted phase timings for signalized intersections within a given area to optimize vehicular flows for the next control period.

18 Claims, 8 Drawing Sheets

METHOD FOR REGIONAL SYSTEM WIDE OPTIMAL SIGNAL TIMING FOR TRAFFIC CONTROL BASED ON WIRELESS PHONE NETWORKS

FIELD OF THE INVENTION

This invention relates generally to traffic control systems. More specifically, the present invention relates to a traffic control system that optimizes traffic flow based on information obtained via a wireless telephone network.

BACKGROUND OF THE INVENTION

Optimization of Traffic Signal Timings in Regional Traffic Control Systems

Problems in traffic control have been studied extensively over the last few decades. Conventional traffic control systems comprise three major components: hardware infrastructure, information gathering systems, and traffic control software including mathematical models and algorithms. At present we are primarily interested in software models and algorithms, and in information gathering systems.

Existing Methods of Gathering Information on Traffic Conditions

Due to ever increasing traffic volume, traffic control and information acquisition have become an important part of the overall traffic management strategy.

Generally, dynamic traffic data are gathered by three methods:

1. Road sensor devices such as induction loops, traffic detectors, and TV cameras mounted on poles;
2. Mobile traffic units such as police, road service, helicopters, weather reporting devices, etc.
3. Mobile positioning and communication systems using GPS devices or similar vehicle-tracking equipment.

The disadvantages of these data collection methods are summarized as follows:

1. Relatively high cost of required capital investment into road devices especially when carried out within existing road infrastructures;
2. Relatively limited number of organizations such as trucking, delivery and other service companies utilizing reporting vehicles equipped with GPS devices;
3. In general only small geographical areas are effectively covered due to specific nature of service tasks, apart from the relatively small number of cars equipped with required GPS devices necessary for precise position determination.

In a recent development, GPS reporting devices have been mounted on individual cars to provide positioning information of vehicles via wireless mobile communication systems. The additional expenditures required by these mobile systems are much lower than by the traditional methods using fixed road metering. One disadvantage of these systems is in the relatively limited number of cars equipped with required GPS devices necessary for precise position determination, and therefore relatively small geographical areas that can be effectively covered.

Modes of Operation of Traffic Control Systems

As originally coined, the term "traffic control" implied a human operator, i.e. a policeman, or a specially trained dispatcher who directed traffic flows across road intersections. This "controller" used his experience and intuition to evaluate traffic loads and waiting times in various directions and lanes, and for changing phase timing accordingly.

Following the introduction of electric traffic signals at the beginning of the twentieth century, progress in the methods of traffic control closely followed that of the control technology, and subsequently the progress of computer science.

Initially, simple electric clocks allocated a specific amount of time to each phase in a specific pattern to controlled traffic signals. These early clock systems were preset and provided no adjustment for peak traffic periods, or for unusual conditions.

The next step was to create a clock that operated differently at different times of the day, and used several different control patterns for different times of day. Those patterns were determined from historical data.

Starting in the mid-1960's, computers were increasingly utilized in traffic control. These computers made it possible to create actuated controllers that had the ability to adjust the signal phase lengths in response to traffic flow in real time. If no vehicles were detected on an approach to an intersection, the controller could skip that phase or reduce the phase to a fixed minimum time. Thus, the green time for each approach was a function of the traffic flow, and could be varied between minimum and maximum lengths depending on traffic flows.

Modes of operation of modern traffic control systems can be divided into three primary categories: 1) pre-timed; 2) actuated (including both semi-actuated and fully actuated); and 3) traffic responsive. Under pre-timed operation, the master controller sets signal phases and cycle lengths on predetermined rates based on historical data.

An actuated controller operates based on traffic demands as registered by the actuation of vehicle and/or pedestrian detectors. There are several types of actuated controllers, but their main feature is the ability to adjust the phases in response to traffic flow.

A semi actuated controller maintains green on the major street except when vehicles are registered on minor streets, and then always return the right of way to the major street.

A fully actuated controller measures traffic flow on all approaches and makes assignments of the right of way in accordance with traffic demands. As such, a fully actuated controller requires placement of detectors on all approaches to the intersection. Thereby increasing installation and maintenance costs considerably.

In the traffic responsive mode, the system responds to inputs from traffic detectors and may react in one of the following ways:

Use vehicle volume data as measured by traffic detectors;

Perform pattern matching—the volume and occupancy data from system detectors are compared with profiles in memory, and the most closely matching profile is used for decision making;

Perform future traffic prediction—projections of future conditions are computed based on data from traffic detectors.

Control Algorithms for Optimization of Timings for Traffic Signals

A number of algorithms exist that purport to optimize performance of traffic responsive controllers that make use of various techniques such as linear programming, dynamic programming, fuzzy logic, regression analysis, and optimization and prediction procedures. The objective function that is usually set up to be optimized is some measure of overall traffic delay at an intersection or at a number of intersections, while the major control parameter for achieving this is the distribution of green and red light timings among different phases.

The usual framework for those algorithms is as follows. Signal timings should reflect the number of vehicles present on each approach to an intersection and the pattern of arrivals in the near future. The current queue lengths on each approach are identified by locating slow-moving and stationary traffic close to the stop-line. Algorithms minimize the total delay subject to certain constraints. Such constraints are:

1. Adequate capacity for all allowed traffic movements; and
2. Safety constraints (minimum number of seconds for green and inter-green times).

Minimization is performed over the pre-selected planning time horizon, which limits the forward time interval for which computations are made. As optimization is performed continuously, we have a rolling horizon framework.

The rate of delay on an approach is estimated as proportional to the number of vehicles in the queue. Accordingly, the total rate of delay at the intersection is the sum over all streams of these rates of delay. The objective function for optimization is the sum of those total rates of delay over the planning time period, which represents the total delay incurred. A slightly different formulation of the objective of optimization is minimization of the weighted sum of the estimated rate of delay and the number of stops per unit time for all traffic streams. In such a formulation the problem is amenable to treatment by mathematical optimization methods. In particular, by dynamic programming and linear programming techniques.

Most conventional attempts for real time responsive control are either optimized on a per intersection basis or make highly restrictive simplifying assumptions in treating multiple intersection problems. Still, there are a few works treating area-wide traffic control optimization problems. For example, U.S. Pat. No. 5,668,717 issued to James C. Spall proposed the use of neural networks that are able to learn patterns of traffic situations, store them for future use and modify them when the traffic situation changes.

It appears, though, that at the present time no widely accepted and approved method exists for optimizing traffic control signals on an area wide scale.

SUMMARY OF THE INVENTION

In view of the shortcomings of the prior art, it is an object of the present invention to provide a system and method for optimizing traffic flow based on information received from wireless telephone systems.

The above-identified disadvantages of the prior art systems may be overcome by using wireless networks as the sole means to provide location information. Technologically, this may be achieved by measuring the distances the signals traveling between a moving wireless (cellular) phone and a fixed set of base stations, and the times these signals take to travel. This information may then be applied to mathematical and statistical methods to solve the resulting equations.

This exemplary approach takes advantage of improved accuracy of measurement methods and of the large pool of wireless handsets that exist. For example, in the United States alone there are presently about 50 million such handsets. Furthermore, any necessary modifications, such as specialized location equipment, can be made on the network rather than on the handsets.

The present invention utilizes a cell phone network in which the data from moving vehicles are collected continuously and input into the system. The exemplary system filters and cleans the data by applying intelligent heuristic algorithms and produces accurate real time information on traffic situations that, in turn, can be supplied to automated traffic controllers. This eliminates the need for developing a dedicated mobile wireless information gathering fleet and other high cost devices requiring large capital investments and considerable work force.

Network system wide control is the means for real time adjustment of the timings of all signals in a traffic network to achieve a reduction in overall congestion consistent with the chosen system wide measure of effectiveness. This real time control is preferably responsive to instantaneous changes in traffic conditions including changes due to various traffic incidents. Also, the system is preferably adaptive in order to reflect daily and hourly non-recurring events, such as unexpected traffic pattern changes, temporary lane closures, etc., as well as long-term evolution in transportation systems like seasonal effects, permanent road changes, infrastructure development, etc. To achieve system wide optimization, the timings at different signalized intersections will not, in general, have predetermined relationships to one another except possibly for those signals along transportation arteries, where it will be preferable to synchronize the intersections.

The present invention utilizes an intelligent data gathering and processing system based on information flow from existing cellular phone networks, and uses such obtained cell phone based position data for real time computation of adjusted phase timings at signalized intersections.

The system of the present invention is capable of constructing and maintaining lists of vehicles moving along road sections at particular periods of time. This is achieved by tracking a predetermined number of in-vehicle cell phones within a given region. The exemplary system maintains a series of such lists associated with the previous elapsed time period and calculates estimates of the numbers of vehicles traveling on each particular road section, their actual traveling times, and the turning times and go-through times for all signalized intersections. Thus, the exemplary system is able to (1) compute real time traffic loads for various roads and road sections, (2) generate detailed lists and descriptions of vehicle turning movements, (3) compute real time turning data for all relevant intersections, and (4) estimate other relevant traffic parameters. The resulting information setup (with numerous relevant parameters estimated on the basis of observations) is then transferred with minimum delay to the automated traffic control system for the purpose of adjusting phase timings at signalized intersections for the next control time period. In other words, based on the traffic flow data obtained for the previous control time period, the system attempts to adjust phase timing at signalized intersections in such a way as to provide more green time for more heavy traffic flows at the expense of less loaded roadways for the next control time period. Roughly speaking, the longer travel time has been registered at a particular turn during the previous control time period, the more green light the intersection is going to get at the next time period.

This result may be achieved by maximizing a linear function in green light timings the coefficients of which are functions of time delays affected at all road sections during the previous control time period within the given region. Optimization is achieved under certain constraints, such as minimal and maximal values of green light timings, safety constraints expressing minimum number of seconds for inter-green times at each intersection, and other relevant constraints which could be set up individually for any turn and go-through of any signalized intersection, etc. The new values of green light timings obtained from the optimization will be applied to the next control time period during which new measurements of traffic travel times and traffic flows will be made as before, and the whole process will be repeated.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION OF THE INVENTION

One purpose of the present invention is to optimize the phase timings at signalized intersections in such a way as to relieve the most jammed portions of the network at the expense of its less loaded portions. In an exemplary embodiment of the present invention, this may be achieved by collecting location data from the maximum possible number of vehicles moving in a given region, estimating of traffic loads on all road sections and turns, and then by adjusting phase timings to ease the most congested roadways.

Naturally, the extent and the precision of the overall data collected from the plurality of cell phones in the given network will largely depend on the total number of current cell phone users as well as on the technology used for measuring and recording the data. It should be noted here that for purposes of the present invention, data collection is based on any cell phone in an "on" position, and as such will be considered part of the reporting system.

The present invention does not deal with problems related to the precision of the cell phone location methods, but rather presumes existing cell phone location technologies and anticipates their progressive improvement in the future. It is also assumed that increasing competition in the cell phone market will further enhance the already large popularity of cell phone usage by the public.

In the exemplary system, all relevant cell phone position data will be obtained directly from the cell phone network operator without any involvement of the individual phone user. After receiving all location data, the system proceeds to compute travel times for all road sections and turns, and optimizes the phase timings accordingly.

Figure 1:
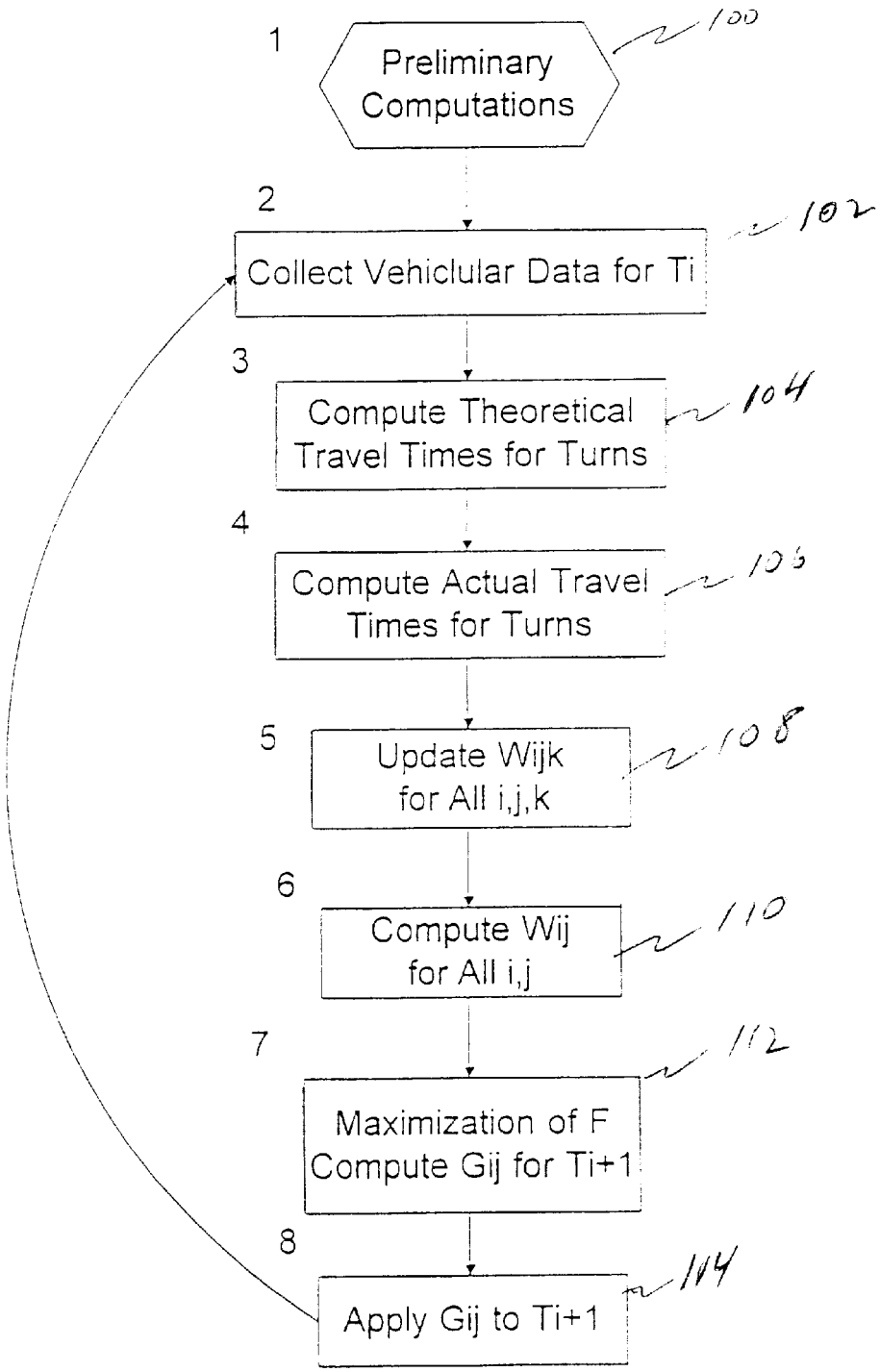
FIG. 1 is a flowchart representation of the traffic control system for an exemplary embodiment of the present invention.
Figure 2A:
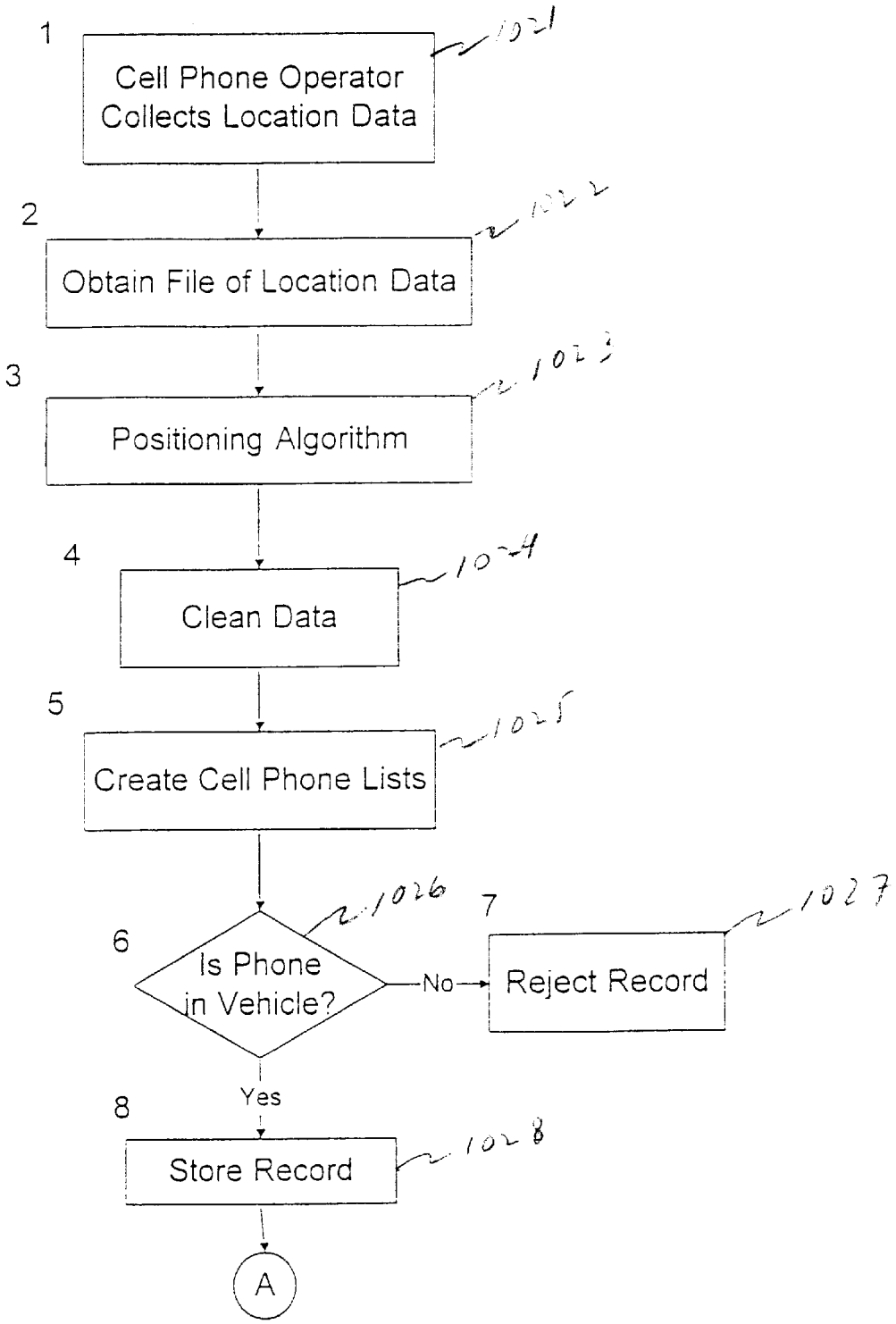
FIGS. 2A–2B are a detailed flowchart of Step 102 shown in FIG. 1.
Figure 2B:
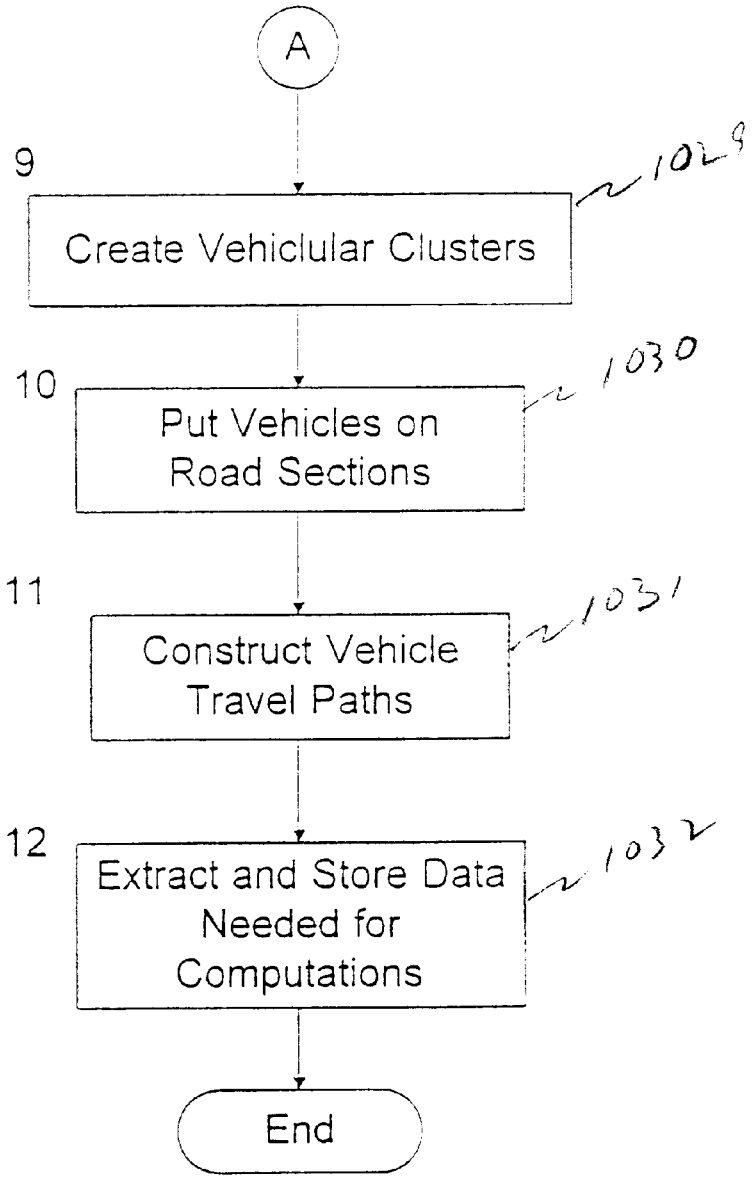
Figure 3:
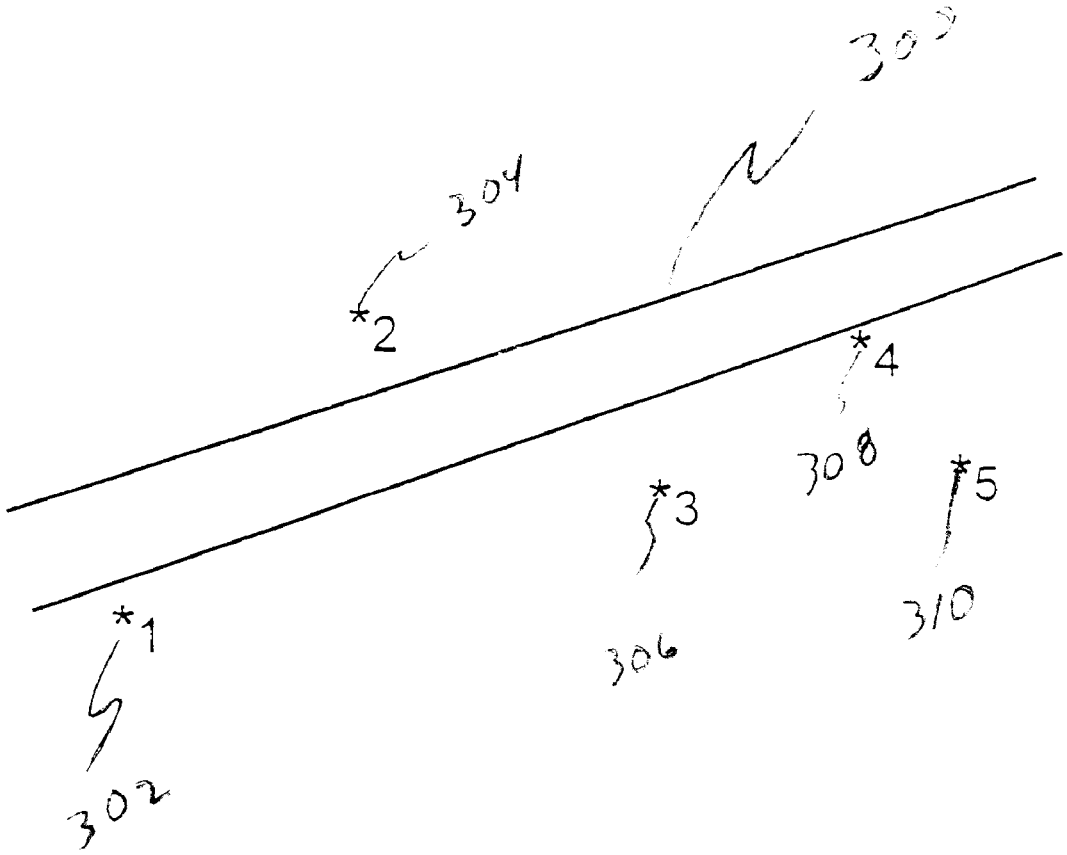
FIG. 3 is a example of measured positions of a cell phone in a vehicle moving along a road section.

FIGS. 1–3 are a representation of the exemplary cell phone gathering system. The following main steps of data exchange flow are described in detail below.

1. Overview of Control Scheme and of Computational Method
2. Obtaining Cell Phone Records From the Network Operator
3. Creating and Storing the Current and Previous Cell Phone Lists
4. Creating Preliminary Cell Phone Path Profiles
5. Cleaning the Data
6. Discrimination Between Phones in Moving Vehicles and Other Phones
7. Grouping Cell Phones Into Vehicular Clusters
8. Theoretical Travel Times for Turns and Go-throughs
9. Actual Travel Times for Road Sections, Turns and Go-throughs
10. Maximization of Objective Function F, Computation of Resulting Phase Timings, and Applying Them for The Next Control Period
11. Future Embodiments And Additional Applications

Overview of Control Scheme and of Computational Method

As indicated above, the exemplary system and method uses traffic data obtained during the previous control time period $T_s$ for adjusting phase timings at signalized intersections at the next control time period $T_{s+1}$ in such a way as to provide more green light time for more heavy traffic flows at the expense of less loaded roadways. This is achieved by maximizing a linear function F in green light timings $G_{ij}$ $$F = \sum_{i,j} W_{ij} G_{ij}$$

where, i indexes signalized intersections within the given region, j runs over the green lights at intersection i, and coefficients $W_{ij}$ measure time delays resulting from traffic congestions.

The new values of green light timings $G_{ij}$ resulting from the optimization of F will be applied to the control period $T_{s+1}$ during which new measurements of traffic delays will be made as before, and the whole process will be repeated.

To compute the values of $G_{ij}$, we will perform the maximization of F above under the system of constraints $$G_{ij,min} \leq G_{ij} \leq G_{ij,max}$$

and $$G_{i,\min} \leq \sum_{j} G_{ij} \leq G_{i,\max}$$

where computation of weights $W_{ij}$ will be explained below, the constants $G_{ij,min}$, $G_{ij,max}$, $G_{i,min}$ and $G_{i,max}$ are assumed known, and i and j are as defined above.

Apart from the listed constraints, the minimization problem may contain other relevant constraints, such as safety constraints expressing minimum number of seconds for inter-green times at each intersection. As their structure is quite similar to the listed above constraints, however, we will not try to enumerate all of them explicitly, and will presume they have been included into the system of constraints above.

Maximization of F can be performed by standard linear programming techniques.

Computation of Weights $W_{ij}$

For maximization of F we need to know the weights $W_{ij}$. These weights indicate an increase in waiting times resulting from traffic congestion at the corresponding intersections.

The weights $W_{ijk}$ are computed where, k is the index number of turn at the intersection i controlled by the green light j. The weights $W_{ijk}$ are computed by the formula $$W_{ijk}=t_{ijk}|T_{ijk}$$

where, $t_{ijk}$ is an average actual travel time for the turn k averaged over a number of vehicles that made that turn during the previous time period, and $T_{ijk}$ is the theoretical (regular) travel time for that turn.

The travel times $t_{ijk}$ will be called actual travel times, and the travel times $T_{ijk}$ the theoretical travel times. Now, the weights $W_{ij}$ are computed by the formula $$W_{ij} = \sum_k W_{ijk}$$

and substituting them into the function F, we can perform optimization as described above and compute the corresponding green light timings $G_{ij}$.

Obtaining Cell Phone Records from the Network Operator

It is assumed that the cell phone network operator is capable of providing all the necessary information on the plurality of active cell phone units in the network. The process of collecting and transmitting cell phone position data is well known to those skilled in the art and described in the literature.

For the purposes of the present invention it is contemplated that the data are received in the form of periodic data packets in real time, such as every 1 to 3 minutes, for example. The exemplary packet file consists of a list of records, each for a single cell phone, containing the phone's unique ID number, the recorded time of signal reception t, and its location P (x, y):

$$record(CP)=(ID,t,x,y)$$

For the purposes of protecting privacy of individual cell phone users, an automatic coding system set up by the network operator will assign to each cell phone number a unique ID reference number. In the exemplary embodiment of the present invention, only the reference ID will be used to identify each cell phone record.

Creating And Storing the Current And Previous Cell Phone Lists

At each time period $T_i$, the Traffic Control System compiles a current phone list consisting of cell phone records (in the sense defined above) of all available active cell phones in a system database ordered by their ID reference numbers. At the next control period $T_{i+1}$, a new current phone list is compiled and recorded similarly, with the first current phone list becoming the previous phone list number 1. At the following control period, a new current phone list is compiled, the current phone list becomes the previous phone list number 1, and the previous phone list number 1 becomes the previous phone list number 2, etc. For the purposes of analysis, it may be necessary to store at any given moment a predetermined number of those lists, such as, 4 or 5 for example.

Creating Preliminary Cell Phone Path Profiles

To track moving vehicles, it will be convenient to create a temporary cell phone path profile for each active cell phone in a given area and to place individual cell phone positions onto the digital map. The exemplary map database contains a list of all road sections, each with a number of fixed attributes such as road name, the names of two adjacent intersection nodes, permissible speed, number of lanes, turns to and from the nodes, sensor devices if available, automatic traffic control signals, and all other pertinent data. For each individual cell phone, we define its original path profile as a series of its database records, i.e. initial location measurements. The path profile for a cell phone can only be constructed if the re-determined number of its latest recorded positions is available.

FIG. 3 illustrates a cell phone path profile along road section 300 based on positions 302, 304, 306, 308, 310 of a cell phone (not shown). Note that due to measurement errors those recorded cell phone positions will generally not lay on the road the vehicle traveled by, but rather in the vicinity of it. To correct for this, the Positioning Algorithm disclosed in co-pending patent application no. 09/xxxxxx, filed Jul. 10, 2001 and assigned to the same assignee as the present invention, may be used for finding most likely positions of cell phones on road sections. This co-pending application is entitled "Traffic Information Gathering via Cellular Phone Networks for Intelligent Transportation Systems" and is incorporated herein by reference. In brief, the Positioning Algorithm works as follows. Given a point P' (recorded cell phone position), the Positioning Algorithm searches for a point P nearest to point P' located on one of the closest road sections. Such a point is deemed to be the most probable position of the cell phone.

After all recorded cell phone positions have been adjusted and associated with individual road sections, the adjusted phone list is created with all cell phones placed on road sections.

For some computations required by the traffic model, continuous paths will be used as travel routes rather than lists of cell phone positions. Construction of such continuous path profiles can be achieved by simple interpolation and extrapolation techniques, in particular by constructing linear regression curves. It is assumed that valid interpolations and extrapolations can be performed within the given road section.

Even with less than predetermined number of recorded positions, linear regression or interpolation may still be performed although precision may suffer. On the other hand, one should be warned again attempting extrapolation over section boundaries. It appears that while the assumption of validity of interpolation and extrapolation within a common road section is tenable, extrapolating across section boundaries is not recommended. This is due to abrupt changes in speed that often occur while switching between sections, long waiting times near intersections, possible congestion at section ends, sudden stops that drivers make before entering highways, various turning point delays, etc.

Cleaning the Data

A continuous cell phone path profile constructed by means of the Positioning Algorithm and interpolations and extrapolations may not always be satisfactory. As a matter of fact, due to large measurement errors and the closeness of road sections to one another, especially in dense urban areas, it may occur that outliers, i. e. untenable cell phone positions, have been included into the path profile.

Figure 4:
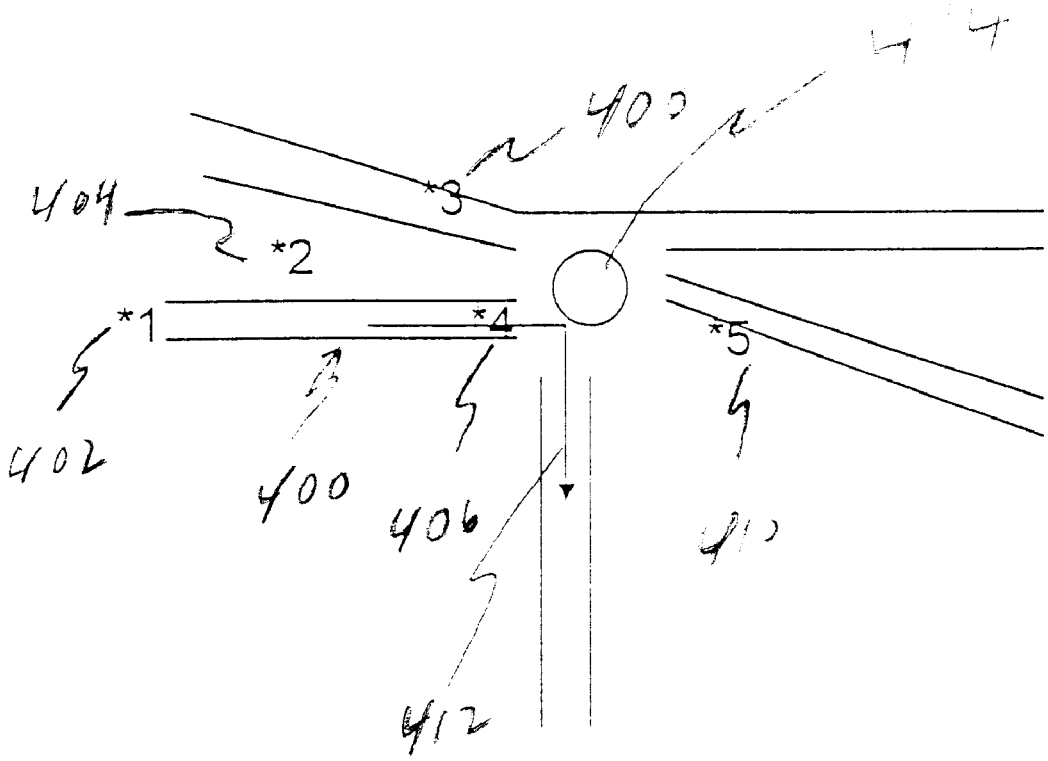
FIG. 4 is an example of outlying vehicle positions in the vicinity of an intersection.

FIG. 4 is an example of outlying vehicle positions in the vicinity of intersection 414. In the series of vehicle positions 402, 404, 406, 408, 410 shown in FIG. 4, positions 408, 410 are outliers. Line 412 illustrates the path taken by the subject vehicle.

For the process of construction of continuous cell phone path profiles, outlying positions (408, 410 shown in FIG. 4) are misleading records that may severely impair or invalidate the continuous cell phone path, which has been influenced by it. Therefore, it is requisite to use statistical procedures for filtering or cleaning the data prior to cell phone path construction, or after attempting path construction. In any case, before proceeding to the following computations, the observed cell phone positions should be checked for validity and consistency. Furthermore, if some observable cell phone positions are missing due to technical errors or other reasons, statistical procedures for treating missing observations should be applied. Examples of such procedures can be found in the co-pending patent application referred to above (Traffic Information Gathering via Cellular Phone Networks for Intelligent Transportation Systems).

Discrimination Between Phones In Moving Vehicles And Other Phones

Once the list of all cell phone profiles has been set up, it should be analyzed as to which phones are located in traveling vehicles and which are not. In fact, phones located in traveling vehicles usually possess some attributes not found with other phones. As a result, some of these attributes can be used for separating phones located in moving vehicles, on the one hand, and all other phones on the other. Among those other phones may be stationary phones, such as phones inside houses, phones left in parked cars, slowly moving phones such as phones held by pedestrians, fast moving phones located in trains, held by bicycle and motorcycle riders which may be moving in the open without regard to any roads, and probably many other cases difficult to envision and enumerate. Roughly speaking, phones moving along discernible roads with speeds that, at least part of the time, are significantly greater than speeds of pedestrians should be classified as phones in moving vehicles. A formal and detailed discriminating procedure for performing this task may be found in aforementioned co-pending patent application (Traffic Information Gathering via Cellular Phone Networks for Intelligent Transportation Systems).

Grouping Cell Phones Into Vehicular Clusters

After the phones travelling in moving vehicles have been identified with a minimum number of errors, it is necessary to identify and eliminate the possibility that two or more cell phones traveling in a single vehicle will mistakenly be recorded as two or more moving vehicles. If this is allowed to happen, it will lead to misrepresenting the actual number of moving vehicles or the "vehicular load" on a particular road section and to distortion of general picture representing the traffic situation at the given moment.

In our co-pending patent application (Traffic Information Gathering via Cellular Phone Networks for Intelligent Transportation Systems), procedures for 1) grouping moving phones into vehicular clusters, 2) positioning thus constructed vehicular clusters onto roads, and 3) constructing continuous path profiles for them are described. The net result is a list of vehicular clusters moving along particular roads in a given time period.

Theoretical Travel Times for Turns and Go-throughs

As indicated in the first section Overview of Control Scheme and of Computational Method, the weights $W_{ijk}$ were computed by the formula $$W_{ijk}=t_{ijk}|T_{ijk}$$

where, $t_{ijk}$ are actual travel times, and $T_{ijk}$ are theoretical travel times.

Actual travel times for turns and go-throughs include waiting due to congestion conditions, while theoretical travel times do not.

First, theoretical travel times $T_{ijk}$ are computed, and in the next section a method for estimating actual travel times $t_{ijk}$ is described.

Let $t_r$ denote the time during which the red light is on, and similarly $t_g$ the time for a green light. Denote by $E(t_{wait}|\text{red})$ the mathematical expectation of the waiting time if the driver arrived to the intersection when the red light was on, and similarly $E(t_{wait}|\text{green})$ for green. Also denote by Pr(red) the probability that the red light is on when the driver arrives at the intersection, and similarly Pr(green) the probability of the green light. Now, the expectation of the waiting time can be computed by the total probability formula:

$$Et_{wait}=E(t_{wait}|\text{red})\Pr(\text{red})+E(t_{wait}|\text{green})\Pr(\text{green})$$

Since $E(t_{wait}|\text{green})=0$, this simplifies to $$Et_{wait}=E(t_{wait}|\text{red})\Pr(\text{red})$$

It is easily seen that $E(t_{wait}|\text{red})=t_r/2$, and $\Pr(\text{red})=t_r/(t_g+t_r)$,
resulting in:

$$Et_{wait}=t^2_r/(2(t_g+t_r))$$

This formula gives the mean waiting time of the driver arriving at an intersection under ideal traffic conditions with no congestion and no delays whatsoever.

Actual Travel Times for Road Sections, Turns and Go-throughs

In this section a method for estimating actual travel times $t_{ijk}$ for turns and go-throughs is described. First, however, some definitions are necessary.

For computing actual travel times for traveling across a road network, it is convenient to represent each two-way road section as a pair of one-way sections. Also, as each road intersection contains a number of changeovers (turns and go-throughs) from one section to another, it will be useful to represent each such changeover from an incoming section to an outgoing section by a new abstract transition segment possessing its own travel time.

Figure 5:
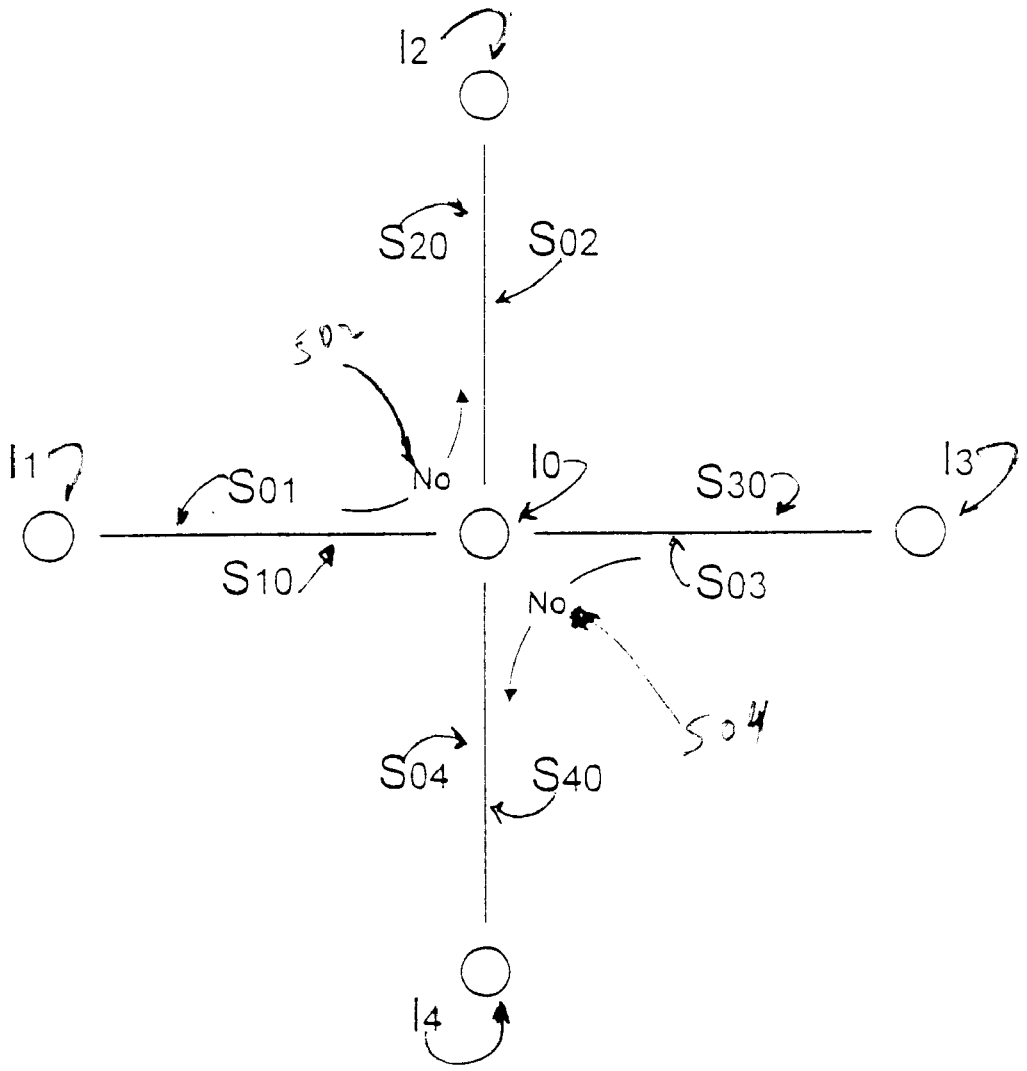
FIG. 5 is an exemplary intersection of two two-way roads.

FIG. 5 shows a rather simple example of an intersection of two two-sided roads. The intersection itself is marked by $I_0$, and the neighboring intersections are denoted $I_1$, $I_2$, $I_3$ and $I_4$.

Section $S_{10}$ goes from intersection $I_1$ to intersection $I_0$, section $S_{01}$ goes from intersection $I_0$ to intersection $I_1$, section $S_{02}$ goes from intersection $I_0$ to intersection $I_2$, etc., so that we have 8 separate one-sided road sections.

All the turns and pass-throughs at $I_0$ are permissible except for two left turns: the turn from $S_{10}$ to $S_{02}$ (502) and the turn from $S_{30}$ to $S_{04}$ (504) are not allowed.

Figure 6:
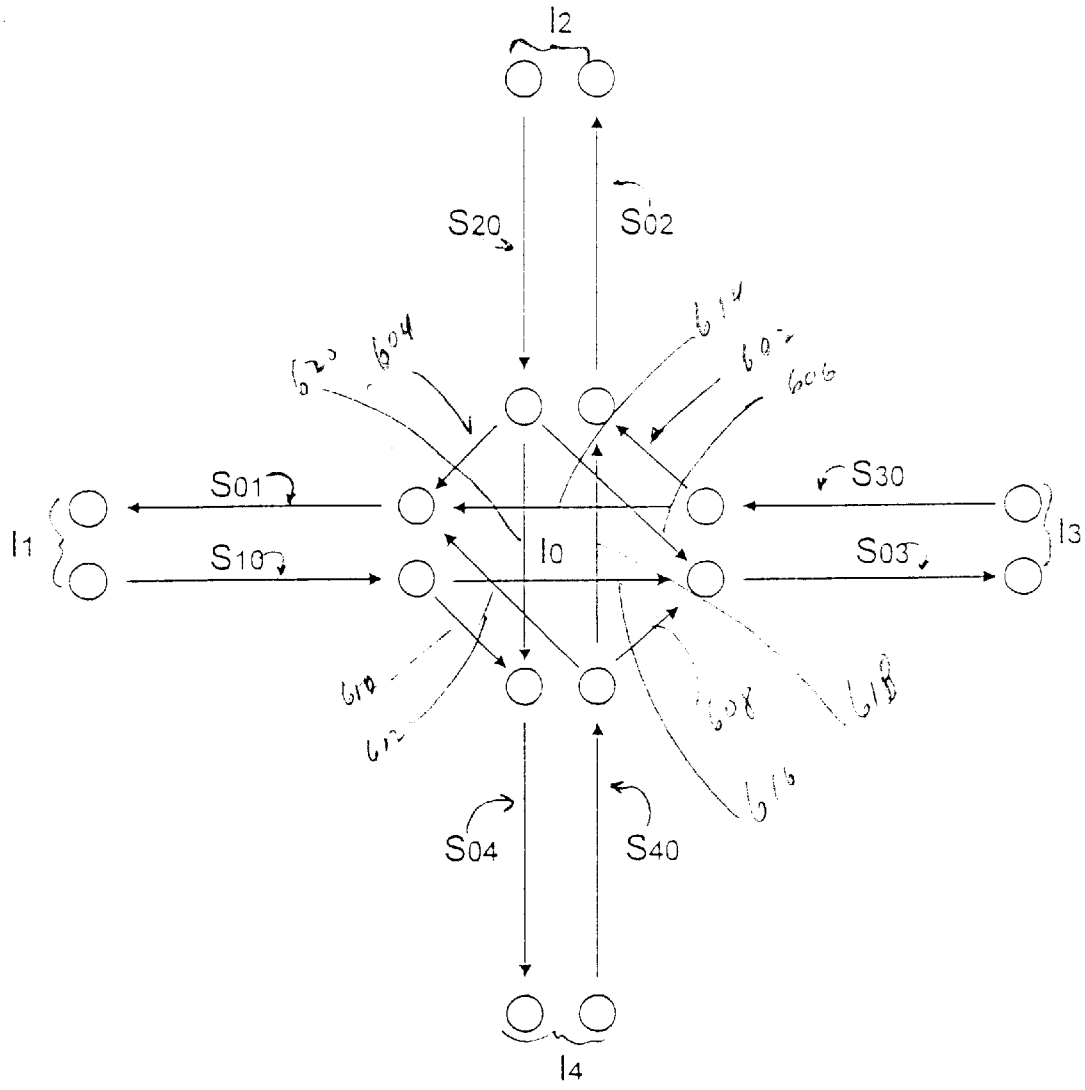
FIG. 6 is a topologically equivalent detailed map of the intersection shown in FIG. 5.

A topologically equivalent detailed map of the intersection area in FIG. 5 is shown in FIG. 6. In FIG. 6, all two-sided sections are shown as pairs (I1, I2, I3, I4) of one-sided sections with travel directions indicated by arrows ($S_{01}$, $S_{10}$, $S_{02}$, $S_{20}$, $S_{03}$, $S_{30}$, $S_{04}$, $S_{40}$). Permissible turns (602, 604, 606, 608, 610, 612) and go-throughs (614, 616, 618, 620) are also shown by arrows so that, e.g., the incoming section $S_{10}$ is followed by two arrows connecting it to the outgoing section $S_{04}$ (right turn) and to the outgoing section $S_{03}$ (go-through). Similarly, the incoming section $S_{40}$ is followed by three arrows connecting it to the outgoing section $S_{01}$ (left turn), to the outgoing section $S_{02}$ (go-through) and to the outgoing section $S_{03}$ (right turn). In total, there are 10 additional transition segments, i. e. permissible changeovers, out of 12 theoretically possible transition segments.

Geometrical sizes of the additional transition segments connecting road sections are negligible whereas times spent on them by the drivers are not.

The actual travel time associated with the transition segment connecting section $S_{10}$ to section $S_{04}$, for example, will include the waiting time by red light, time spent in a vehicle queue, times spent on slow-downs and speeding up, actual turning time, etc. Including all those times into a new transition segment will allow to "free" travel times of road sections from "wait and turn" times and thereafter to estimate both types of travel times separately and more accurately.

Figure 7:
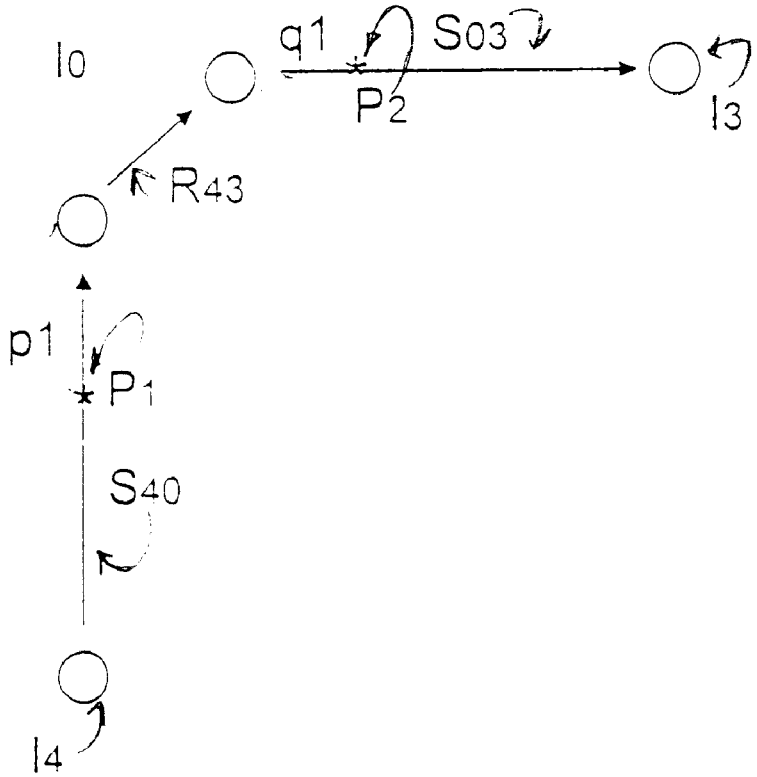
FIG. 7 is an estimation of actual travel times for various portion of the intersection shown in FIG. 6.

A method that may be used for estimating travel times for various transition segments is now presented. Consider the right turn (608 in FIG. 6) from the incoming section $S_{40}$ to the outgoing section $S_{03}$ shown separately in FIG. 7 and denoted by $R_{43}$ . Let the length of $S_{40}$ be $l_1$, and the length of $S_{03}$ be $t_2$. Also, let the actual travel time for $S_{40}$ be $t_1$, the actual travel time for $S_{03}$ be $t_2$, and the actual travel time for the turn $R_{43}$ be $t_0$. The values $l_1$ and $l_2$ are known, whereas the times $t_1$, $t_2$ and $t_0$ are unknown and should be estimated via location signals from cell phones in traveling vehicles.

Now, assume that a traveling vehicle was observed at some point $P_1$ on section $S_{40}$ at time moment $z_1$, and next at a point $P_2$ on section $S_{03}$ at time moment $z_2$ . Thereby, the coordinates of both points $P_1$ and $P_2$ are known.

Let the distance from $P_1$ up to the end of section $S_{40}$ be $p_1 * I_1$, and the distance from the beginning of section $S_{03}$ to the point $P_2$ be $q_1 * I_2$ . Assuming that the vehicle has spent time $p_1 * t_1$ for traveling the distance $p_1 * I_1$ on section $S_{40}$, and time $q_1 * t_2$ for traveling the distance $q_1 * I_2$ on section $S_{03}$, we can write an equation $$p_1 * t_1 + t_0 + q_1 * t_2 = T_1$$

where $T_1 = z_2 - z_1$ is known.

If we observed signals from n (greater than 3) vehicles that traveled by section $S_{40}$, and then turned to the right to section $S_{03}$, we will be able to write n equations similar to the equation above:

$$p_1 * t_1 + t_0 + q_1 * t_2 = T_1$$

$$p_2 * t_1 + t_0 + q_2 * t_2 = T_2$$

$$\ldots$$

$$p_n * t_1 + t_0 + q_n * t_2 = T_n$$

This system is a linear regression model whose solutions $\hat{t}_1$, $\hat{t}_0$, $\hat{t}_2$ will give the sought for estimates for the corresponding travel times.

Similar systems associated with other turns and go-throughs related to the present intersection and also to all other intersections within a given region produce estimates for all travel times of interest.

Maximization of Objective Function F, Computation of Resulting Phase Timings, and Applying Them for The Next Control Period After the actual travel times $t_{ijk}$ for all turns and go-throughs have been estimated during the time period $T_s$, and their theoretical counterparts $T_{ijk}$ computed, we can compute the weights $W_{ijk}$ and $W_{ij}$ and then use a linear programming method for performing maximization of the objective function F under the restrictions laid out in the first section. Optimization produces the corresponding values of green light timings $G_{ij}$ that bring F to its maximum. Those values will be used as control variables during the next control period $T_{i+1}$, new data will be collected, and the whole computation cycle repeated. The process is shown schematically in FIG. 1.

FIG. 1 is a flowchart of an exemplary embodiment of the inventive traffic control system and method. At Step 100 preliminary computations are performed. At Step 102, data is collected from vehicles during control time period $T_i$. At Step 104, theoretical travel times for turns are computed. At Step 106, actual travel times for turns are computed. At Step 108, weights $W_{ijk}$ for all values of indexes i, j and k are updated. At Step 110, weights $W_{ij}$ for all values of indexes i and j are computed. At Step 112, maximization of objective function F and computation of all corresponding values of is performed. At Step 114, the green light timings $G_{ij}$ obtained at Step 112 are applied to the next control period $T_{i+1}$ and the process is reentered at Step 102.

FIGS. 2A and 2B provide a detailed flowchart of Step 102 shown in FIG. 1. At Step 1021, location data is received and collected by the cell phone operator. At Step 1022, the file containing the location data is transferred to the traffic control system. At Step 1023, a Positioning Algorithm for putting cell phones on road sections is applied to the location data. At Step 1024, the resulting data is subjected to a filtering or cleaning process. At Step 1025, cell phone lists are created. At Step 1026, a special algorithm is applied to each cell phone record to determine if a particular cell phone is in a traveling vehicle. If the cell phone is determined not to be located within a traveling vehicle at Step 1026 the record is rejected at Step 1027 and the process ends. On the other hand, if the cell phone is determined to be located within a traveling vehicle at Step 1026 the record is stored in a memory system at Step 1028. At Step 1029, the vehicular clusters representing moving vehicles are created. At Step 1030, the vehicles are put onto road sections by the Positioning Algorithm. At Step 1031, the vehicle travel paths along the road sections are constructed by interpolation methods. At Step 1032, the data relating to the vehicle positions, travel routes, etc., needed for adjusting phase timing and other traffic control computations are prepared and stored in the database.

Future Embodiments And Additional Applications

As described above with respect to the exemplary embodiment, the present invention provides a system and method for calculating a large number of traffic characteristics and parameters not readily available under other systems. In particular, it allows computation or estimation of the following parameters and quantities: actual travel times of all road sections within a given geographical region; actual travel times of all road turns and go-throughs at all signalized intersections within a given geographical region; short-term predictions of those quantities; and current vehicle loads on all road sections within a given geographical region.

Based on the above quantities, many important statistical historical data items may be computed and stored for future use, including the use by third parties. Among such data are: vehicle loads at particular roads categorized by days, hours, etc., vehicle densities at particular roads categorized by days, hours, etc., vehicle densities in the vicinities of signalized intersections, average speeds along important arteries categorized by days, hours, etc.

Also, numerous additional types of information may be computed based on the above. These real time or historical data can be readily transmitted to other client application programs such as guided navigation systems, traffic related and congestion studies, emergency services 911, etc.

Although the invention has been described with reference to exemplary embodiments, it is not limited thereto. Rather, the appended claims should be construed to include other variants and embodiments of the invention which may be made by those skilled in the art without departing from the true spirit and scope of the present invention.

What is claimed:

1. A method for controlling and adjusting phase timings at all signalized intersections within a given geographical region with the purpose of allocating more green light time for roads with heavier traffic flows at the expense of less loaded roadways comprising the steps of:

acquiring of dynamic traffic information from a cellular network provider or a group of cellular network providers and from GPS based technology whenever available for the purpose of monitoring movements of as many traveling vehicles in a given region as possible;

continuously or periodically obtaining location data on plurality of cell phones in the regional network in a specific real time frame;

determining for each particular cell phone whether the cell phone terminal is located in a traveling vehicle;

setting up a list of all cell phones currently identified as located in traveling vehicles;

compiling and updating a sequence of real time positions of each cell phone located in a traveling vehicle;

positioning each cell phone located in a traveling vehicle onto an appropriate road section at each particular moment according to its coordinates;

eliminating untenable cell phone positions (outlying positions) by analyzing series of recently recorded positions and relating them to nearby road sections;

making imputations for missing cell phone positions by analyzing series of recently recorded positions and relating them to nearby road sections;

calculating feasible continuous paths for all cell phones located in traveling vehicles within a given time period;

identifying multiple phones in a common vehicle and combining them into a single vehicular cluster entity based on closely located positions at corresponding time moments and common direction of movement;

calculating feasible continuous paths for vehicular clusters within a given time period; and storing the relevant position data for each individual vehicle (vehicular cluster) traveling along a given road section in the database for the purpose of maintaining vehicle's recent path information.

2. The method according to claim 1, wherein the plurality of road sections include a plurality of controlled intersections, the method further comprising the steps of:

(k) maintaining and updating for each of the plurality of road sections a list of vehicles presently traveling along it;

(l) maintaining and updating for each of the plurality of road sections a list of vehicles that exited it within a predetermined period of time;

(m) updating the database based on the lists provided in steps (k) and (l);

(n) providing for each turn and each go-through of each controlled intersection the list of vehicles that passed there within a predetermined period of time;

(o) determining an estimated travel time for each of the plurality of road sections; and (p) determining an estimated time for traversing each of the plurality of controlled intersections.

3. The method according to claim 2, further comprising the steps of:

(q) maintaining and updating lists of moving vehicles for corresponding road sections together with other relevant information;

(r) maintaining and updating lists of vehicles for corresponding road sections that exited them within a predetermined period of time together with other relevant information;

(s) maintaining and updating estimates of averaged recent travel times for road sections;

(t) maintaining and updating estimates of averaged crossing times for signalized intersections;

(u) estimating and updating the current status of the traffic situation and traffic flow at each road section;

(v) estimating and updating the current status of the traffic situation and traffic flow at each signalized intersection; and (w) calculating estimated turning proportions of vehicles on signalized intersections.

4. The method according to claim 2, further comprising the steps of:

(q) maintaining and updating an estimate of averaged recent travel time for each road section; and (r) maintaining and updating an estimate of averaged recent times for at least one of turning within and traversing through the plurality of controlled intersections.

5. A method according to claim 1 for estimating and adjusting previously computed green light timings at all signalized intersections in a given geographical region for the next time period comprising the steps of:

maximization (under appropriate restrictions) of a linear objective function in green light timings with the coefficients that measure time delays at all signalized intersections resulting from traffic congestion;

computing the values of green light timing variables that bring the linear objective function to its maximum; and applying the obtained values of green light timing variables to the corresponding signalized intersections for controlling phase timings during the next time period.

6. The method according to claim 5, wherein the plurality of controlled intersections each have a respective control signal, the method further comprising the steps of:

(o) determining a theoretical respective traversal time for each of the controlled intersections within at least a portion of the predetermined region;

(p) determining an estimated respective traversal time for each of the controlled intersections within at least the portion of the predetermined region;

(q) determining the coefficients used in the linear objective function of step (l) in claim (3);

(r) measuring time delays as ratios of the estimated travel times of step (p) and the theoretical respective traversal times of step (o) for each one of the plurality of controlled intersections; and (s) determining the linear objective function of step (l) in claim (3) to be maximized as a function of a timing of the control signal based on a time delay measured in step (r) at the plurality of controlled intersection.

7. The method according to claim 1, wherein the plurality of road sections include a plurality of controlled intersections each having a respective control signal, the method further comprising the steps of:

(k) determining a theoretical respective travel time for each of the controlled intersections within at least a portion of the predetermined region;

(l) determining an estimated respective traversal time for each of the controlled intersections within at least the portion of the predetermined region;

(m) determining the coefficients used in the linear objective function of step (l) in claim (3);

(n) measuring time delays as ratios of the estimated traversal times of step (l) and the theoretical respective traversal times of step (k) for each one of the controlled intersections; and (o) determining the linear objective function of step (l) in claim (3) to be maximized as a function of a timing of the control signal based on a time delay measured in step (n) at the corresponding controlled intersection.

8. A method according to claim 1 for storing and updating traffic situations at road sections and signalized intersections in a regional road system comprising the steps of:

maintaining and updating lists of moving vehicles together with other relevant information for road sections;

maintaining and updating lists of vehicles for road sections that recently exited them together with other relevant information;

maintaining and updating estimates of averaged recent travel times for road sections;

maintaining and updating estimates of averaged crossing times for signalized intersections;

estimating and updating the current status of the traffic situation and traffic flow at each road section;

estimating and updating the current status of the traffic situation and traffic flow at each signalized intersection; and calculating turning proportions of vehicles on signalized intersections.

9. The method according to claim 1, wherein the plurality of road sections include a plurality of controlled intersections each having a respective control signal, the method further comprising the steps of:

(k) collecting and storing real time road traffic data for the plurality of road sections in the predetermined geographical region;

(l) providing the data to at least one of a vehicle-based navigation system and an Internet based traffic server;

(m) collecting historical statistical traffic data for i) the plurality of road sections and ii) the plurality of controlled intersections on a periodic basis; and (n) generating a short term prediction and a long term prediction of traffic volumes and travel times for the plurality of road sections and the plurality of controlled intersections.

10. The method according to claim 1, wherein the traffic information is acquired from the at least one of i) road sensors, ii) mobile traffic reporting units, and iii) vehicle-tracking equipment.

11. The method according to claim 1, further comprising the step of:

(k) interpolating for a missing observation of position for at least one of the plurality of cell phones.

12. The method according to claim 11, wherein the interpolating step (k) is based on analyzing a series of stored positions of the corresponding cell phone and relating them to further road sections.

13. The method according to claim 1, wherein the path constructed in step (i) is a continuous path.

14. The method according to claim 1, wherein the combining step (h) is based on (i) distances among the multiple cell phones at consecutive times and (ii) a direction of movement of each of the multiple cell phones.

15. The method according to claim 1, wherein the database stored in step (j) maintains recent path information for each of the plurality of vehicle clusters.

16. The method according to claim 1, wherein the acquiring step (a) also acquires data from a satellite based positioning system.

17. The method according to claim 1, wherein the location data is obtained within a predetermined time period.

18. The method according to claim 1, wherein step (g) is based on an analysis of previous cell phone positions and local structure within the plurality of road sections.

* * * * *